United States Patent [19]

Azar et al.

[11] 4,049,447

[45] Sept. 20, 1977

[54] IMAGING SYSTEM

[75] Inventors: Jack C. Azar, Rochester; Thomas A. Hoffend, Webster, both of N.Y.; Burton B. Jacknow, Monte Sereno, Calif.

[73] Assignee: Xerox Corporation, Stamford, Conn.

[21] Appl. No.: 657,504

[22] Filed: Feb. 12, 1976

Related U.S. Application Data

[63] Continuation of Ser. No. 211,131, Dec. 22, 1971, abandoned.

[51] Int. Cl.[2] ..... G03G 9/08; G03G 13/08; G03G 13/22

[52] U.S. Cl. ..... 96/1 SD; 252/62.1 P; 427/19

[58] Field of Search ..... 252/62.1 P; 427/19; 96/1 SD

[56] References Cited

U.S. PATENT DOCUMENTS

| | | | |
|---|---|---|---|
| 3,547,822 | 12/1970 | Miller | 252/62.1 P |
| 3,590,000 | 6/1971 | Palermiti et al. | 252/62.1 P |

*Primary Examiner*—James R. Hoffman
*Attorney, Agent, or Firm*—James J. Ralabate; Ernest F. Chapman

[57] ABSTRACT

A finely divided particulate toner composition is provided comprising a colorant and an amorphous, low-melting aromatic polyester wherein the polyester contains within the polymer chain at least about 30 mole percent of at least one divalent radical selected from the group consisting of:

a. an asymmetrical arylene radical represented by the formula:

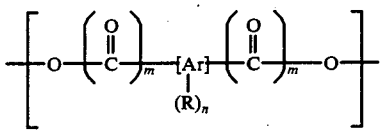

wherein [Ar] is a divalent arylene radical containing from 6 to about 18 carbon atoms, R is selected from the group of radicals consisting of hydrogen, alkyl containing from 1 to about 4 carbon atoms, halo, sulfo and alkali metal salts thereof, nitro, cyano, lower alkoxy, amino, thio lower alkoxy and $-N(R')_p$ wherein each R' can be independently hydrogen or lower alkyl and p is an integer of 2 or 3, each m is independently a number from 0 to 1 and n is a number from 0 to 3, and b. an asymmetrical alkylene radical represented by the structural formula:

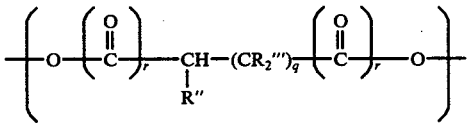

wherein R'' is an alkyl radical containing from 1 to about 4 carbon atoms, each R''' is independently hydrogen or R'', $q$ is a number from 1 to about 10 and each $r$ is independently a number from 0 to 1.

23 Claims, No Drawings

IMAGING SYSTEM

This is a continuation, of application Ser. No. 211,131, filed Dec. 22, 1971 now abandoned.

This invention relates to imaging systems, and more particularly, to improved electrostatographic developing materials, their manufacture and use.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting latent electrostatic image by depositing on the image a finely-divided electroscopic material referred to in the art as "toner". The toner will normally be attracted to those areas of the layer which retain a charge, thereby forming a toner image corresponding to the latent electrostatic image. This toner image may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing steps.

Several methods are known for applying the electroscopic toner particles to the latent electrostatic image to be developed. One development technique, as disclosed by E. N. Wise in U.S. Pat. No. 2,618,552, is known as "cascade" development. In this method, a developer material comprising relatively large carrier particles having finely-divided toner particles electrostatically clinging thereto is conveyed to and rolled or cascaded across the electrostatic latent image-bearing surface. The composition of the carrier particles is so selected as to triboelectrically charge the toner particles to the desired polarity. As the mixture cascades or rolls across the image-bearing surface, the toner particles are electrostatically deposited and secured to the charged portion of the latent image and are not deposited on the charged or background portions of the image. Most of the toner particles accidentally deposited in the background are removed by the rolling carrier, due apparently, to a greater electrostatic attraction between the toner and the carrier than between the toner and the discharged background. The carrier and excess toner are then recycled. This technique is extremely good for the development of line copy images.

Another method of developing electrostatic images is the "magnetic brush" process as disclosed, for example, in U.S. Pat. No. 2,874,063. In this method, a developer material containing toner and magnetic carrier particles are carried by a magnet. The magnetic field of the magnet causes alignment of the magnetic carrier into a brush-like configuration. This magnetic brush is engaged with the electrostatic image-bearing surface and the toner particles are drawn from the brush to the latent image by electrostatic attraction.

Still another technique for developing electrostatic latent images is the "powder cloud" process as disclosed, for example, by C. F. Carlson in U.S. Pat. No. 2,221,776. In this method, a developer material comprising electrically charged toner particles in a gaseous fluid is passed adjacent to the surface bearing the latent electrostatic image. The toner particles are drawn by electrostatic attraction from the gas to the latent image. This process is particularly useful in continuous toner development.

Other development methods such as "touchdown" development as disclosed by R. W. Gundlach in U.S. Pat. No. 3,166,432 may be used where suitable.

Although some of the foregoing development techniques are employed commercially today, the most widely used commercial electrostatographic development technique is the process known as cascade development. A general purpose office copying machine incorporating this development method is described in U.S. Pat. No. 3,099,943. The cascade development technique is generally carried out in a commercial apparatus by cascading a developer mixture over the surface of an electrostatic latent image-bearing drum having a horizontal axis. The developer is transported from a trough or sump to the upper portion of the drum by means of an endless belt conveyor. After the developer is cascaded downward along the upper quadrant surface of the drum into the sump, it is recycled through the developing system to develop additional electrostatic latent images. Small quantities of toner are periodically added to the developing mixture to compensate for the toner depleted by development. The resulting toner image is usually transferred to a receiving sheet and thereafter fused by suitable means such as oven or radiant fusing. The surface of the drum is thereafter cleaned for reuse. This imaging process is then repeated for each copy produced by the machine and is ordinarily repeated many thousands of times during the usable life of the developer.

Thus, it is apparent from the description presented above as well as other development techniques, that the toner is subjected to severe mechanical attrition which tends to break down the particles into undesirable dust fines. The formation of fines is retarded when the toner contains a tough, high molecular weight resin which is capable of withstanding the shear and impact forces imparted to the toner in the machine.

Unfortunately, many high molecular weight materials cannot be employed in high speed automatic machines because they cannot be rapidly fused during a powder image heat fixing step. Attempts to rapidly fuse a high melting point toner by means of oversized, high capacity heating units have met with the problems of preventing charring of the paper receiving sheets and of adequately dissipating the heat evolved from the fusing unit or units. In some cases, the receiving sheet has actually burst into flames after passage through the fusing unit. Thus, in order to avoid charring or combustion, additional equipment such as complex and expensive cooling units are necessary to properly dispose of the large quantity of heat generated by the fuser. Incomplete removal of the heat evolved will result in operator discomfort and damage to heat sensitive machine components. Further, the increased space occupied by and the high operating costs of the heating and cooling units often outweigh the advantages achieved by the increased machine speed. On the other hand, vinyl resins which are easily heat fused at relatively low temperatures are usually undesirable because these materials tend to smear or form thick films on reusable photoconductor surfaces. These films tend to cause image degradation and contribute to machine maintenance down time. Many low molecular weight vinyl resins decompose when subjected to fusing conditions in high speed copying and duplicating machines. In addition, some low melting vinyl resins tend to form tacky images on the copy sheet which are easily smudged and often offset to other adjacent sheets. Moreover, these low molecular weight resins often produce substantial quantities of dust, i.e., sub-micron particles in conventional grinding apparatus which is undesirable in machine operation.

It is also quite important that the toner material which is composed of resin and pigment be capable of accepting a charge of the correct polarity when brought into rubbing contact with the surface of carrier materials in cascade or touchdown development systems. The triboelectric and flow characteristics of many toners are adversely affected by changes in the ambient humidity. For example, the triboelectric values of some toners fluctuate with changes in relative humidity and are not desirable for employment in electrostatographic systems, particularly in precision automatic machines which require toners having stable and predictable triboelectric values. Therefore, resins useful for toner applications should be insensitive to variations in relative humidity. Another factor affecting the stability of carrier triboelectric properties is the tendency of some toner materials to "impact" on the surface of carrier particles. When developers are employed in automatic cascade developing machines and recycled through many cycles, the many collisions which occur between the carrier and toner particles in the machine cause the toner particles carried on the surface of the carrier particles to be welded or otherwise forced into the surface of the carrier particles. The gradual accumulation of permanently attached toner material on the surface of carrier particles causes a change in the triboelectric value of the carrier particles and directly contributes to the degradation of copy quality by eventual destruction of the toner carrying capacity of the carrier.

Numerous known carriers and toners are abrasive in nature. Abrasive contact between toner particles, carriers, and electrostatographic imaging surfaces accelerates mutual deterioration of these components. Replacement of carriers and electrostatic image bearing surfaces is expensive and time consuming.

Low melting crystalline polymers would be advantageous as low energy fusing toner materials. Although crystalline polymers generally exhibit sharp melting points, it has been found, however, that many of these polymers, especially those of low molecular weight, melt sharply generally forming low viscosity liquids which tend to run and/or blot on the transfer sheet. Moreover, low melting crystalline polyesters, for example, are relatively conductive resulting in charge dissipation prior to completion of transfer of toner to the transfer sheet causing poor copy quality. Additionally, crystalline polymers which do exhibit low melting points have also been found to result in images which tend to readily smear because of the waxy nature of the polymer.

Since most thermoplastic materials are deficient in one or more of the above areas, there is a continuing need for improved toners and developers.

It is, therefore, an object of this invention to provide developer compositions which overcome the above-noted deficiencies.

It is another object of this invention to provide a toner which is stable at toner fusing conditions in high speed copying and duplicating machines.

It is another object of this invention to form a toner which can be fused at higher rates with less heat energy.

It is another object of this invention to provide a toner which is triboelectrically stable under varying humidity conditions.

It is another object of this invention to provide a toner which is resistant to blocking in storage and use.

It is another object of this invention to provide a toner which is readily removable by carriers from background areas during image development.

It is another object of this invention to provide a toner which will resist smearing and be easily cleaned from electrostatic imaging surfaces.

It is another object of this invention to provide a toner which reduces mechanical abrasion of electrostatic imaging surfaces.

It is another object of this invention to provide a toner which is effective at low initial electrostatic surface potentials.

It is another object of this invention to provide a toner which forms dense toner images.

It is another object of this invention to provide a toner which is readily transferrable from an electrostatographic imaging surface to a transfer surface.

It is another object of this invention to provide a toner which is resistant to mechanical attrition during the development process.

It is another object of this invention to provide a toner and developer having physical and chemical properties superior to those of known toners and developers.

It is another object of this invention to provide amorphous polyester toners exhibiting a low melting range with acceptable blocking temperatures.

These as well as other objects are accomplished by the present invention which provides finely divided particulate toner compositions comprising a colorant and an amorphous, low-melting aromatic polyester wherein the polyester contains within the polymer chain at least about 30 mole percent of at least one divalent radical selected from the group consisting of:

a. an asymmetrical arylene radical represented by the formula:

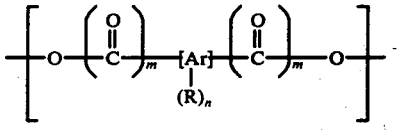

wherein [Ar] is a divalent arylene radical containing from 6 to about 18 carbon atoms, R is selected from the group of radicals consisting of hydrogen, alkyl containing from 1 to about 4 carbon atoms, halo, sulfo and alkali metal salts thereof, nitro, cyano, lower alkoxy, amino, thio lower alkoxy and $-N(R')_p$ wherein each R' can be independently hydrogen or lower alkyl and $p$ is an integer of 2 or 3, each $m$ is independently a number from 0 to 1 and $n$ is a number from 0 to 3, and b. an asymmetrical alkylene radical represented by the structural formula:

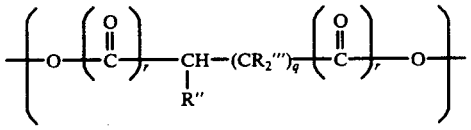

wherein R'' is an alkyl radical containing from 1 to about 4 carbon atoms, each R''' is independently hydrogen or R'', $q$ is a number from 1 to about 10 and each $r$ is independently a number from 0 to 1.

As employed herein, the term "asymmetrical" is intended to denote a structure having no center of symmetry, i.e., it contains no point such that any straight line through that point passes through exactly the same environment in the two directions extending from that point (Organic Chemistry, Cram and Hammond, McGraw-Hill, New York (1959) p. 127). Such asymmetrical structures introduce disorder in the polymer chains such that ordering of the polymer molecules into three dimensional arrays is prevented from occuring.

It has been found that the amorphous, low melting aromatic polyesters of the present invention fuse (i.e., provide a permanently fixed image to the transfer sheet) at relatively low temperatures generally ranging from about 100° C. to about 130° C. Toners prepared from such polyesters require appreciably less power for fusing to occur using a regenerative hot air fuser or a hot pressure roll fuser, for example, as compared to currently available toner compositions. These polyester resins having a softening temperature as measured by the Vicat softening test (ASTM D152565T) of at least about 45° C. and a fusion point of about 130° C. or below, fusion point being defined herein as the temperature at which the polymer melt viscosity is $10^4$ poise.

Thus, toner prepared from the polyesters of the present invention can be employed in high speed automatic reproduction machines since they can be rapidly fused at low temperatures. Moreover, these polyesters, being amorphous and aromatic in nature, are essentially nonconductive thereby retaining their triboelectrically generated charge resulting in good image quality. These polyesters generally exhibit a resistivity of at least about $10^{15}$ ohm-cm. Also, as compared to the blocking tendency exhibited by low melting amorphous vinyl polymers, the low melting amorphous aromatic polyesters of the present invention are substantially free of blocking problems. Still further, as compared to the amorphous aromatic polyesters employed in the present invention, amorphous aliphatic polyesters are all liquids and therefore unsuitable for the purposes herein. Also, crystalline aliphatic polyesters which fuse in the desired range generally exhibit high conductivity, i.e., resistivities less than about $10^{15}$ ohm-cm. Because of this, they exhibit very poor triboelectric values and electrostatographic properties.

The polyesters of the present invention can be prepared by any conventional condensation or transesterification polymerization process. The polymerization can be conducted using polymerization techniques such as bulk, solution, interfacial and the like. Any suitable comonomers can be employed such as dicarboxylic acids or esters, hydroxy acids, dicarboxylic acid chlorides, dicarboxylic acid anhydrides with aliphatic or aromatic diols. Additionally, dihalohydrocarbons and salts of dicarboxylic acids or diols can be employed.

It is considered critical, however, in obtaining the low melting, amorphous aromatic polyesters employed in the present invention that at least one of the monomers employed to form the polymer supply at least about 30 mole percent of a divalent radical selected from the group consisting of:

a. an asymmetrical arylene radical represented by the formula:

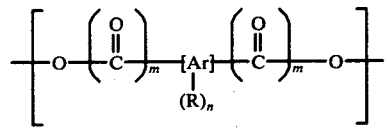

wherein [Ar] is a divalent arylene radical containing from 6 to about 18 carbon atoms, R is selected from the group of radicals consisting of hydrogen, alkyl containing from 1 to about 4 carbon atoms, halo, sulfo and alkali metal salts thereof, nitro, cyano, lower alkoxy, amino, thio lower alkoxy and —N(R')$_p$ wherein each R' can be independently hydrogen or lower alkyl and p is an integer of 2 or 3, each $m$ is independently a number from 0 to 1 and n is a number from 0 to 3, or b. an asymmetrical alkylene radical represented by the structural formula:

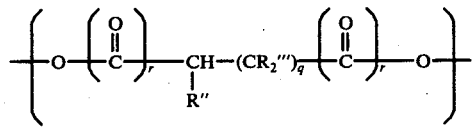

wherein R'' is an alkyl radical containing from 1 to about 4 carbon atoms, each R''' is independently hydrogen or R'', $q$ is a number from 1 to about 10 and each $r$ is independently a number from 0 to 1 to the resulting polymer. As long as one of the monomers is a compound which is capable of providing the required amount of a radical as defined above, the choice of the other monomer or monomers is dictated only by the requirements that the ultimate polymer be aromatic in nature and that the polymer exhibit a Vicat softening point of at least about 45° C. For purposes of this invention, a polymer is considered aromatic in nature when it exhibits a resistivity of at least about $10^{15}$ ohm-cm. Generally, such resistivity can be obtained by employing at least about 20 mole percent of an aromatic monomer and preferably, by employing at least about 35% of an aromatic monomer in the preparation of the polyester. This aromatic monomer can, although it need not, be the source of the asymmetrical arylene radical defined hereinabove.

Illustrative compounds which are adapted to supply the asymmetrical arylene radical:

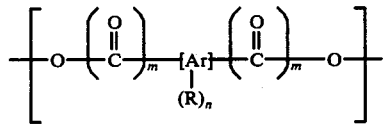

as defined above to the polymer chain can be either arylene dicarboxy radicals or arylene dioxy radicals. Illustrative arylene dicarboxy radicals are phthalic acid, isophthalic acid, phthalic anhydride, phenylindandicarboxylic acid, diphenyl-m, m'-dicarboxyylic acid, naphthalene-1,4-dicarboxylic acid, naphthalene-1,6-dicarboxylic acid and the like. Illustrative arylene dioxy radicals are resorcinol, catechol, 1,6-naphthalene diol, 1,4-naphthalene diol, 2,7-naphthalene diol, 4-tert butyl catechol, m-di(hydroxymethyl) benzene and the like.

Illustrative compounds which are adapted to supply the asymmetrical alkylene radicals to the polymer chain can be either alkylene dioxy radicals or alkylene dicarboxy radicals such as 1,2-propylene glycol, 1,2-butylene glycol, 1,3-butylene glycol, 2,3-butylene glycol, 2-methyl-1,3-propylene glycol, polypropylene glycol, 2-methyl-2,4-pentanediol, β-methyl adipic acid, bromosuccinic acid, methyl succinnic acid, $C_{36}$ dimer acid (dimer of linoleic acid) and the like.

It has been found that at least about 30 mole percent of at least one of the above-defined radicals is required in the polymer chain in order to impart the amorphous nature and low melting point to the polymer. When said radicals are present in amounts less than about 30 mole percent, the resulting polyesters are generally crystalline, i.e., melt over a narrow range, and conductive. However, lesser amounts, e.g., at least about 20 mole percent, can be suitably employed in instances wherein the other comonomers employed introduce sufficient disorder into the polymer chains such that ordering of the polymer molecules into three dimensional arrays is prevented from occuring. The stoichiometry of the polymerization reaction will, of course, dictate the maximum amount of the radical present in the polymer chain. Any amount from the minimum of at least about 30 mole percent up to the stoichiometric limit can be suitably employed.

The selection of the remaining comonomers is dictated only by the requirements of the condensation or transesterification reaction and the need to obtain a final product which is aromatic in nature and which exhibits a Vicat softening temperature of at least about 45° C. For example, if the required amount of one of the above-defined radicals is introduced through an asymmetrical diacid such as phthalic acid, there is no restriction on the other monomer(s) except that it or they be capable of reacting with the diacid to form an aromatic polyester having a Vicat softening temperature of at least about 45° C. Illustrative diols which can suitably be employed are the aliphatic diols or aromatic diols such as ethylene glycol, 1,3-propylene diol, trimethylene glycol, tetramethylene glycol, 1,4-butylene diol, 1,5-pentylene diol, pentamethylene glycol, hexamethylene glycol, heptamethylene glycol, octamethylene glycol, nonamethylene glycol, decamethylene glycol, diethylene glycol, tri-ethylene glycol, tetraethylene glycol, p-di(hydroxymethyl)-benzene, cis and trans quinitol, hydroquinone, hydroquinone di-(β-hydroxyethyl)ether, 4,4'-dihydroxy biphenyl, bis-(4-hydroxyphenyl)methane, bis-(4-hydroxyphenyl)diphenylmethane, bis-(hydroxyphenyl)ketone, bis-(hydroxyphenyl)ether, bis-(hydroxyphenyl)sulfone and the like.

Similarly, if one monomer provides the requisite amount of the asymmetrical alkylene radical, the remaining monomer or monomers can be any aromatic diacid or analogous anhydride, acid chloride or salt thereof. Illustrative monomers are terephthalic acid, trans-hexahydro terephthalic acid, p-carboxyphenyl acetic acid, diphenyl-p,p'-dicarboxylic acid, diphenyl-4,4'-diacetic acid, diphenylmethane-p,p'-dicarboxylic acid, benzophenone-4,4'-dicarboxylic acid, naphthalene-2,7-dicarboxylic acid, naphthalene-2,6-dicarboxylic acid, p-carboxyphenyloxy acetic acid, 1,2-diphenoxyethane-p,p'-dicarboxylic acid, 1,3-diphenoxypropane-p,p'-dicarboxylic acid, 1,4-diphenoxybutane-p,p'-dicarboxylic acid, p(p-carboxyphenoxy) benzoic acid, p(p-carboxybenzoyloxy)benzoic acid and the like. Also included are the analogous anhydrides of such acids, when they exist, and the acid chlorides and salts thereof. If desired, more than one diacid, anhydride, acid chloride or salt can be employed to form a copolyester.

The polyesters of the present invention can be prepared by any conventional polyester preparation procedure. The molecular weight of the polyester can vary widely without affecting the amorphous nature of the polymer. Preferably, low molecular weight, i.e., number average molecular weights below about 3,000, are suitable for toners used in oven fusing or radiant fusing. The low molecular weight polyesters of the present invention exhibit low viscosities which is especially important in oven or radiant fusing, and do not cold flow or impact as readily as vinyl polymers. It has been determined that a particular melt viscosity correlates well with the fusibility of a toner in an oven or radiant fusing device. This viscosity is $10^4$ poises at 30 seconds$^{-1}$ shear rate. The temperature at which the toner reaches this viscosity is denoted as the "isoviscous temperature" and is considered the fusing temperature of the toner. The higher molecular weight polyesters, i.e., those having number average molecular weights above 3000 and generally between about 3,000 and about 10,000 are especially suitable as toners for use in heated pressure roll fusing apparatus. In hot pressure roll fusing systems, the "fusing window" afforded by the polymer is quite important in achieving the necessary degree of operational latitude. The fusing window is the temperature range between initial fixing of the toner to the paper as measured by a Taber Abrader, for example, and the temperature at which the toner cohesively fails, offsetting to the fuser roll due to its low viscosity. Preferably the fusing window is a minimum of about 25° C to ensure the necessary degree of operational latitude generally encountered in hot pressure roll fusing systems.

Any suitable pigment or dye can be employed as the colorant for the toner particles. Toner colorants are well known and include, for example, carbon black, nigrosine dye, aniline blue, Calco Oil Blue, chrome yellow, ultra marine blue, Quinoline Yellow, methylene blue chloride, Monastral blue, Malachite Green Oxalate, lampblack, Rose Bengal, Monastral Red, Sudan Black BN, and mixtures thereof. The pigment or dyes should be present in the toner in a sufficient quantity to render it highly colored so that it will form a clearly visible image on a recording member. Thus, for example, where conventional electrostatographic copies of typed documents are desired, the toner may comprise a black pigment such as carbon black or a black dye such as Sudan Black BN dye available from GAF Corporation. Preferably, for sufficient color density, the pigment is employed in an amount from about 1 to about 20% by weight, based on the total weight of the colored toner. If the toner colorant employed is a dye, substantially smaller quantities of colorant may be used. The colorants may be mixed with the resin component prior to, during or after the resin component is polymerized. Obviously, any colorant which inhibits polymerization should be blended with the resin after the resin is formed.

The toner compositions of the present invention can be prepared by any well known toner mixing and comminution technique. For example, the ingredients can be thoroughly mixed by blending and milling the components and thereafter micropulverizing the resulting mixture. Another well known technique for forming toner particles is to spray dry or freeze dry a suspension, a hot melt, or a solution of the toner composition.

When the toner mixtures of this invention are to be employed in cascade development processes, the toner should have an average particle diameter less than about 30 microns and preferably between about 3 and about 10 microns for optimum results. For use in powder cloud development methods, particle diameters of slightly less than 1 micron are preferred.

Suitable coated and uncoated carrier materials for cascade and magnetic brush development are well known in the art. The carrier particles can be electrically conductive, insulating, magnetic or non-magnetic, provided that the carrier particles acquire a charge having an opposite polarity to that of the toner particles when brought into close contact with the toner particles so that the toner particles adhere to and surround the carrier particles. When a positive reproduction of an electrostatic image is desired, the carrier particle is selected so that the toner particles acquire a charge having a polarity opposite to that of the electrostatic latent image. Alternatively, if a reversal reproduction of the electrostatic image is desired, the carriers are selected so that the toner particles acquire a charge having the same polarity as that of the electrostatic image. Thus, the materials for the carrier particles are selected in accordance with its triboelectric properties in respect to the electroscopic toner so that when mixed or brought into mutual contact, one component of the developer is charged positively if the other component is below the first component in the triboelectric series and negatively if the other component is above the first component in the triboelectric series. By proper selection of materials in accordance with their triboelectric effects, the polarities of their charge when mixed are such that the electroscopic toner particles adhere to and are coated on the surfaces of carrier particles and also adhere to that portion of the electrostatic image-bearing surfaces having a greater attraction for the toner than the carrier particles. Typical carriers include sodium chloride, ammonium chloride, aluminum potassium chloride, Rochelle salt, sodium nitrate, aluminum nitrate, potassium chlorate, granular zircon, granular silicon, methyl methacrylate, glass, silicon dioxide, iron and alloys thereof and the like. The carriers can be employed with or without a coating. Many of the foregoing and typical carriers are described by L. E. Walkup in U.S. Pat. No. 2,618,551; L. E. Walkup et al in U.S. Pat. No. 2,638,416 and E. N. Wise in U.S. Pat. No. 2,618,522. An ultimate coated carrier particle diameter between about 50 microns to about 1,000 microns is preferred because the carrier particles than possess sufficient density and inertia to avoid adherence to the electrostatic images during the cascade development process. Adherence of carrier beads to electrostatographic drum surfaces is undesirable because of the formation of deep scratches on the surface during the image transfer and drum cleaning steps, particularly where cleaning is accomplished by a web cleaner such as the web disclosed by W. P. Graff, Jr. et al in U.S. Pat. No. 3,186,838. Also, print deletion occurs when carrier beads adhere to electrostatographic imaging surfaces. Generally speaking, satisfactory results are obtained when about 1 part toner is used with about 10 to about 200 parts by weight of carrier.

The toner compositions of the present invention can be employed to develop electrostatic latent images on any suitable electrostatic latent image-bearing surface including conventional photoconductive surfaces as well as insulating surfaces. Well known photoconductive materials include vitreous selenium, organic or inorganic photoconductors embedded in a non-photoconductive matrix, and the like. Representative patents in which photoconductive materials are disclosed include U.S. Pat. No. 2,803,542to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

The following examples further define, describe and compare methods of preparing the toner materials of the present invention and of utilizing them to develop electrostatic latent images. Parts and percentages are by weight unless otherwise indicated.

In the following examples, polyesters were prepared from a wide variety of diols and diacids by conventional condensation polymerization techniques. The polyesters were analyzed to determine their composition, molecular weight, melting point or range, morphology, i.e, crystalline and amorphous character, as well as other physical properties.

Example 1

This example demonstrates the effect on softening range and morphology of incorporating at least about 50 mole percent of an asymmetrical alkylene dioxy radical into the polyester chain.

Table I summarizes the results obtained.

TABLE I

| Diol | Diacid | Polymer Molar Composition | Softening Range (° C.) | Morphology |
|---|---|---|---|---|
| 1,2-propylene | terephthalic | 1/1 | 77–102 | Amorphous |
| ethylene | terephthalic | 1/1 | 260 | Crystalline |
| 1,3-propylene | terephthalic | 1/1 | 221 | Crystalline |

It can be seen that the asymmetrical alkylene dioxy radical obtained through use of 1,2-propylene diol resulted in the formation of an amorphous polyester exhibiting a significantly lowered softening range than the polyesters obtained from symmetrical diols. Moreover, the polyesters obtained from these latter diols were crystalline in nature.

Example 2

This example demonstrates the effect on softening range and morphology of incorporating at least about 50 mole percent of an asymmetrical arylene dicarboxy radical into the polymer chain as compared with the effect of a symmetrical arylene dicarboxy radical.

The results obtained are summarized in Table II.

TABLE II

| Diol | Diacid | Polymer Molar Composition | Softening Range (° C.) | Morphology |
|---|---|---|---|---|
| HQE[1] | terephthalic | 1/1 | 200 | Crystalline |
| HQE[1] | isophthalic | 1/1 | 50–110 | Amorphous |

[1]HQE = Hydroquinone di-β-hydroxyethyl ether

It can be seen that the asymmetrical isophthalic acid results in a polyester which is amorphous and exhibits a significantly reduced softening temperature as compared with the crystalline polyester obtained with terephthalic acid.

Example 3

This example demonstrates the effect on softening range and morphology of forming a polyester with a symmetrical diacid, terephthalic acid, as compared to polyesters formed from the asymmetrical diacids, isophthalic acid and phthalic acid.

The results obtained are summarized in Table III.

TABLE III

| Diol | Diacid | Polymer Molar Composition | Softening Range (° C.) | Morphology |
|---|---|---|---|---|
| Ethylene | Terephthalic | 1/1 | 260 | Crystalline |
| Ethylene | Isophthalic | 1/1 | 55–78 | Amorphous |
| Ethylene | Phthalic | 1/1 | 45–90 | Amorphous |

Example 4

This example compares poly(ethylene terephthalate), a crystalline, high melting (260° C.) polymer with poly(1,2-propylene terephthalate), a polyester containing an asymmetrical alkylene dioxy radical in the polymer chain thereof. This latter polyester is amorphous and exhibits a low softening range of 77°–102° C. Also, copolyesters formed with varying amounts of both 1,2-propylene glycol and ethylene glycol are compared. The results obtained are summarized in Table IV.

TABLE IV

| Diol | Diacid | Polymer Molar Ratio | Softening Range (° C.) | Morphology | Blocking Temperature (° F.) | Isoviscous Temperature (° C.) |
|---|---|---|---|---|---|---|
| 1,2-propylene | Terephthalic | 1/1 | 77–102 | Amorphous | 145 | 113 |
| 1,2-propylene/ethylene 80/20 | Terephthalic | 0.8/0.2/1 | 53–85 | Amorphous | 130 | 97 |
| 1,2-propylene/ethylene 60/40 | Terephthalic | 0.6/0.4/1 | 56–85 | Amorphous | 120 | 96 |
| 1,2-propylene/ethylene 40/60 | Terephthalic | 0.4/0.6/1 | 175 | Crystalline | >180 | >175 |
| ethylene | Terephthalic | 1/1 | 260 | Crystalline | >180 | >260 |

It can be seen that copolyesters containing as little as about 30%, 1,2-propylene glycol are amorphous and exhibit a low softening range. Also, it can be seen that the formation of copolyesters affords a means of controlling both blocking and isoviscous temperatures.

Example 5

This example illustrates that the presence of as little as 20 mole percent of an asymmetrical alkylene dioxy radical in the copolyester chain is sufficient to provide an amorphous polymer exhibiting a low softening range in an instance wherein another comonomer (HQE) can aid in introducing sufficient disorder into the polymer chain such that ordering of the polymer molecules into three dimensional arrays is prevented from occuring.

The results obtained are summarized in Table V.

TABLE V

| Diol | Diacid | Polymer Molar Composition | Softening Range (° C.) | Morphology |
|---|---|---|---|---|
| 1,2-propylene | Terephthalic | 1/1 | 77–102 | Amorphous |
| 1,2-propylene/HQE 90/10 | Terephthalic | 0.9/0.1/1 | 65–95 | Amorphous |
| 1,2-propylene/HQE 80/20 | Terephthalic | 0.8/0.2/1 | 65–90 | Amorphous |
| 1,2-propylene/HQE 70/30 | Terephthalic | 0.7/0.3/1 | 50–83 | Amorphous |
| 1,2-propylene/HQE 60/40 | Terephthalic | 0.6/0.4/1 | 45–75 | Amorphous |
| 1,2-propylene/HQE 50/50 | Terephthalic | 0.5/0.5/1 | 59–85 | Amorphous |
| 1,2-propylene/HQE 40/60 | Terephthalic | 0.4/0.6/1 | 50–95 | Amorphous |
| 1,2-propylene/HQE 25/75 | Terephthalic | 0.25/0.75/1 | 184–186 | Crystalline |
| HQE | Terephthalic | 1/1 | 200 | Crystalline |

Example 6

This example illustrates that poly(1,2-propylene isophthalate), a polyester wherein both the diol and diacid fall within the critically defined components of the polyesters of the present invention, is an amorphous polymer with a low softening range of 67°–88° C. It can be seen in Table VI below that the effect of going to a copolyester or polyester containing a symmetrical diacid, terephthalic acid, is generally to raise the softening range, blocking temperature and isoviscous temperature.

TABLE VI

| Diol | Diacid | Polymer Molar Ratio | Softening Range (° C) | Morphology | Blocking Temperature (° F) | Isoviscous Temperature (° C.) |
|---|---|---|---|---|---|---|
| 1,2-propylene | Isophthalic | 1/1 | 67–88 | Amorphous | 125–130 | 103 |
| 1,2-propylene | Terephthalic/isophthalic 80/20 | 1/0.8/0.2 | 60–100 | Amorphous | 140 | 102 |

TABLE VI-continued

| Diol | Diacid | Polymer Molar Ratio | Softening Range (° C) | Morphology | Blocking Temperature (° F) | Isoviscous Temperature (° C.) |
|---|---|---|---|---|---|---|
| 1,2-propylene | Terephthalic | 1/1 | 77–102 | Amorphous | 145 | 113 |

EXAMPLE 7

Toner compositions were prepared by admixing 10% by weight Black Pearls carbon black with 90% by weight of the polyesters set forth below in Table VII. After melting and preliminary mixing, the toner compositions were fed to a rubber mill and thoroughly milled to yield a uniformly dispersed composition of the carbon black in the resin body. The resulting mixture was then cooled and finely subdivided in a jet pulverizer to yield toner particles having an average particle size ranging between about 3 to about 6 microns.

About 0.75 to about 1.5 parts by weight of the pulverized toner particles were admixed with from about 98.5 to about 99.25 parts by weight of sand or glass carrier particles having an average particle size ranging from about 250 to about 600 microns, which had been coated with a thin continuous coating of a terpolymer of styrene, methylmethacrylate and vinyl triethoxysilane thereby forming developer mixtures.

The toner and developer mixtures thus obtained are summarized in Table VII below and are compared with a conventional toner comprising a mixture of styrene/n-butyl methacrylate copolymer and poly(vinyl butyral) and containing carbon black as the colorant.

TABLE VII

| Polymer | A | B | C |
|---|---|---|---|
| Diol | 1,2-propylene | 1,2-propylene/ HQE 80/20 | — |
| Diacid | terephthalic | terephthalic | — |
| Polymer Molar Composition | 1/1 | 0.8/0.2/1 | — |
| Softening Range (° C.) | 77–102 | 65–90 | 80–120 |
| Isoviscous Temp. (° C.) | 113 | 102 | 160 |
| Blocking (° F.) | 145 | 130 | 145 |
| $\bar{M}_n$ | 2100 | 1310 | — |
| Morphology | Amorphous | Amorphous | Amorphous |
| Toner | | | |
| Toner Composition (wt. %) | 90% polyester 10% Carbon Black | 90% Copolyester 10% Carbon Black | 90% Polymer 10% Carbon Black |
| Hot Air Fusing | Fuse Point 550° F. | Fuse Point 500° F. | Fuse Point 625° F. |
| Blocking (° F.) | 135–140 | 125–130 | 145 |
| Melt Range (° C.) | 77–102 | 65–90 | 80–120 |
| Isoviscous Temp. (° C.) | 110 | 102 | 160 |
| Developer | | | |
| Toner Concentration | 0.98 wt. % | 1.27 wt. % | 1 % |
| Carrier Composition | Sand[1] | Glass Beads[1] | Sand[1] |

[1]Coated with terpolymer of styrene, methylmethacrylate and vinyl triethoxysilane As compared to the conventional vinyl-type toner, the toner compositions of the present invention can be seen to exhibit lower melting ranges and substantially lower fusing points and isoviscous temperatures with blocking temperatures substantially equivalent to that of the conventional toner.

EXAMPLE 8

The developer compositions obtained in Example 7 were print tested in an automatic recyclable electrostatographic apparatus (Model 813 Xerox copying machine sold by Xerox Corporation, Rochester, New York) to the 500 print level and compared with the conventional developer mixture of Example 7 (C) comprising 1 part toner (6μ) comprising 90% of a mixture of styrene/n-butyl-methacrylate copolymer and poly(vinyl butyral) and 10% carbon black and 99 parts carrier comprising sand (450μ) coated with a terpolymer of styrene, methylmethacrylate and vinyl triethoxysilane.

The results obtained are summarized in Table VIII below.

TABLE VIII

1. Image Quality

| Developer | Print Level | Print Density | Background Density | Maximum Resolution H/v |
|---|---|---|---|---|
| A | 500 | 1.22 | 0.02 | 7/5 |
| B | 500 | 1.20 | <0.01 | 6/7 |
| C | 500 | — | — | — |

2. Developer Characteristics

| Developer | Triboelectric Value (mc/gm) Print Level | Initial | 500 | toner conc. (%) initial | 500 |
|---|---|---|---|---|---|
| A | | 17.60 | 10.10 | 0.98 | 1.80 |
| B | | 26.34 | 29.23 | 0.68 | 0.77 |
| C | | — | — | — | — |

EXAPLE 9

This example compares a crystalline aliphatic polyester, poly(hexamethylene sebacate) with the amorphous aromatic polyesters of the present invention.

The poly(hexamethylene sebate) ($M_n$ 5-10,000) was blended with 10% carbon black to form a toner composition in the same manner as in Example 7. The toner exhibited a resistivity of $3 \times 10^{13}$ ohm-cm., particle size of 7–12 microns, isoviscous temperature of 80° C. and blocking temperature greater than 150° F.

The material was formed into a developer by admixing 1% thereof with 99% of the coated sand carrier described in Example 8.

The resulting toner images after fusing were extremely faint, poorly defined and almost illegible. After about 70 imaging cycles, a heavy film of the toner is formed on the surface of the drum.

In comparison, toner B in Example 8 exhibited a resistivity of $1 \times 10^{16}$ ohm-cm., a particle size of 8–10 microns, an isoviscous temperature of 102° C. and a blocking temperature of 125°–130° F. It can be seen in Table VIII of Example 8 that at the 500 print level, high density, low background images with high resolution were obtained.

Example 10

A sample of Xerox 2400 toner particles sold by the Xerox Corporation, Rochester, New York is employed as a control. Copies of a standard test pattern are made with the toner in an 813 Xerox copying machine modified to enable the obtainment of unfused prints. The unfused prints are fixed upon passage through the nip of a pair of hot silicone pressure rolls operating at 45 copies per minute at a pressure of 40 psi and a nip spacing of 0.75 inch. By varying the temperature of the rolls, the minimum fusing temperature of the toner and its fusing window can be readily determined. In the same manner, a toner obtained in accordance with the present invention comprising 90 parts of a 75/25 copolyester of 1,2-propylene terephthalate/1,2-propylene succinate and 10 parts of carbon black was evaluated and compared with the Xerox 2400 toner. Table IX summarizes the results obtained.

TABLE IX

| | Xerox 2400 Toner | 1,2-propylene Terephthalate 1,2-propylene Succinate copolyester |
|---|---|---|
| Minimum Fuse Temp. (° F.) | 300 | 255 |
| Fusing Window | 70° | 65° |

It can readily be seen that the toner of the present invention exhibits a substantially lower minimum fuse temperature with substantially the same degree of operational latitude as the 2400 toner as shown by the fusing window.

Example 11

This example illustrates the effect of molecular weight on the minimum fuse temperature and fusing window.

Toner compositions were prepared comprising 90 parts of a copolyester of terephthalic acid and an 80/20 mixture of 1,2-propylene glycol and hydroquinone di-β-hydroxyethyl ether, and 10 parts of Black Pearls carbon black. Two batches of this toner were prepared, identical in composition but differing only in molecular weight. In one batch, A, the molecular weight was 5000, in the other, B, 1300. The toners were tested as in Example 10 and the results are summarized in Table X below.

TABLE X

| Toner | Molecular Weight | Minimum Fuse Temperature (° F.) | Hot Offset (° F.) | Fusing Window |
|---|---|---|---|---|
| A | 5000 | 260 | 300–320 | 40–60° |
| B | 1300 | 240 | 260 | 20° |

It can be seen that the lower molecular weight toner exhibits a lower minimum fuse temperature; however, it also exhibits a narrower fusing window. Since a narrow fusing window provides insufficient operational latitude resulting in hot offsetting, the high molecular weight polyesters and copolyesters are preferred for hot roll pressure fusing.

EXAMPLE 12

It has also been found in the present invention that plasticizers can be added to the polyester toners to decrease the minimum fuse point thereof without substantially decreasing the fusing window which should be as broad as possible for proper operational latitude. Thus, plasticizers such as diphenyl phthalate, diphenyl isophthalate, pentaerythritol tetrastearate, pentaerythritol tetrabenzoate, chlorinated biphenyls and the like can suitably be employed. Generally, the plasticizer can be added to the toner composition in amounts ranging from about 5 to about 25 weight percent.

This example illustrates the use of plasticizers to lower the minimum fuse temperature without affecting the fusing window.

A toner composition comprising 90% by weight of a copolyester of terephthalic acid, 1,2-propylene glycol and hydroquinone di-β-hydroxyethyl ether (80/20) and 10% by weight of Black Pearls carbon black was modified by the addition of varying amounts of diphenyl phthalate plasticizer. The minimum fuse temperature and fusing window for each toner was determined and summarized in Table XI below. For purposes of comparison, a conventional toner comprising 90% of a mixture of styrene/n-butyl methacrylate copolymer/poly(vinyl butyral) and 10% carbon black was similarly evaluated.

TABLE XI

| Toner Composition (wt. %) | | | Minimum | Hot | Fusing |
|---|---|---|---|---|---|
| Polymer | Carbon | Black Plasticizer | Fusing Temp. (° F.) | Offset (° F.) | Window (Δ° F.) |
| 90 | 10 | — | 260 | 300–320 | 40–60 |
| 80 | 10 | 10 | 230 | 260 | 30 |
| 70 | 10 | 20 | 200 | 230 | 30 |
| Control | 10 | — | 280 | 310 | 30 |

It can be seen that the addition of plasticizers substantially lowers the minimum fusing temperature without substantially affecting the fusing window. In fact, the plasticized toners still exhibited a fusing window comparable to that of the conventional toner.

What is claimed is:

1. A finely divided particulate toner composition consisting essentially of a colorant and an amorphous, low-melting polyester exhibiting a softening temperature of at least about 45° C, fusing at temperatures ranging from about 100° to about 130° C and exhibiting a resistivity of at least about $10^{15}$ ohm - cm.), wherein the polyester contains within the polymer chain at least about 30 mole percent of at least one divalent radical selected from the group consisting of:

a. an arylene radical represented by the formula:

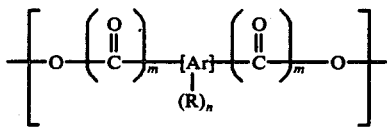

wherein [AR] is an arylene radical containing from 6 to about 18 carbon atoms, R is selected from the group of radicals consisting of hydrogen, alkyl containing from 1 to about 4 carbon atoms, halo, sulfo and alkali metal salts thereof, nitro, cyano, lower alkoxy, amino, thio lower alkoxy and $-N(R')_p$ wherein each R' can be independently hydrogen or lower alkyl and $p$ is an integer of 2 or 3, each $m$ is independently a number from 0 to 1 and $n$ is a number from 0 to 3, and b. an alkylene radical having no center of symmetry represented by the structural formula:

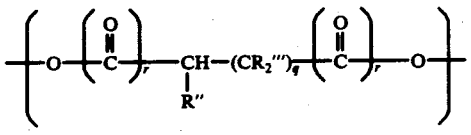

wherein R'' is an alkyl radical containing from 1 to about 4 carbon atoms, each R''' is independently hydrogen or R'', $q$ is a number from 1 to about 10 and each $r$ is independently a number from 0 to 1; and when the radical having no center of symmetry is at least about 30 mole percent of said arylene, the balance of the polyester is aromatic or aliphatic comonomer or both, and when the radical having no center of symmetry is at least about 30 mole percent of said alkylene, the balance of the polyester is at least about 20 mole percent aromatic comonomer, and additional aromatic comonomer or aliphatic comonomer or both.

2. A finely divided particulate toner composition as defined in claim 1 wherein the polyester contains within its chain the residuum of at least about 20 mole percent of an aromatic comonomer capable of polymerization to form a polyester.

3. A finely divided particulate toner composition as defined in claim 1 suitable for use in oven or radiant fusing systems wherein the polyester exhibits a molecular weight below about 3000.

4. A finely divided particulate toner composition as defined in claim 1 suitable for hot pressure roll fusing systems wherein the polyester exhibits a molecular weight between about 3000 and about 10,000.

5. A finely divided particulate toner composition as defined in claim 1 wherein the colorant is carbon black.

6. A finely divided particulate toner composition as defined in claim 1 containing from about 1% to about 20% by weight based on the total weight of toner, of a colorant.

7. A finely divided particulate toner composition as defined in claim 1 wherein the toner exhibits an average particle diameter less than about 30 microns.

8. A finely divided particulate toner composition as defined in claim 1 wherein the polyester is the condensation product of 1,2-propylene glycol and terephthalic acid.

9. A finely divided particulate toner composition as defined in claim 1 wherein the polyester is the condensation product of hydroquinone di-$\beta$-hydroxyethyl ether and isophthalic acid.

10. A finely divided particulate toner composition as defined in claim 1 wherein the polyester is the condensation product of ethylene glycol and isophthalic acid.

11. A finely divided particulate toner composition as defined in claim 1 wherein the polyester is the condensation production of ethylene glycol and phthalic acid.

12. A finely divided particulate toner composition as defined in claim 1 wherein the polyester is the condensation product of 1,2-propylene glycol, hydroquinone di-$\beta$-hydroxyethyl ether and terephthalic acid.

13. A finely divided particulate toner composition as defined in claim 1 wherein the polyester is the condensation product of 1,2-propylene glycol, ethylene glycol and terephthalic acid.

14. A finely divided particulate toner composition as defined in claim 1 wherein the polyester is the condensation product of 1,2-propylene glycol, terephthalic acid and succinic acid.

15. A finely divided toner composition as defined in claim 1 additionally containing from about 5 to about 25 weight percent of a plasticizer.

16. A developer composition comprising a mixture of finely divided particulate toner compositions as defined in claim 1 and carrier particles of relatively opposite triboelectric polarity.

17. A developer composition as defined in claim 16 wherein the carrier particles exhibit a diameter between about 50 microns to about 1000 microns.

18. A developer composition as defined in claim 16 wherein the weight ratio of toner to carrier ranges from about 1:10 to about 1:200.

19. Method for developing electrostatic latent images comprising forming an electrostatic latent image on a surface, contacting the latent image on said surface with the developer composition defined in claim 17 whereby the toner in said developer composition electrostatically adheres to the latent image, and fixing said developed image to said surface.

20. Process as defined in claim 19 wherein the developed electrostatic latent image is transferred to a transfer sheet and the transferred developed image is fixed thereon.

21. A finely divided particulate toner composition comprising a colorant and an amorphous, low-melting polyester exhibiting a softening temperature of at least about 45° C, fusing at temperatures ranging from about 100° C to about 130° C and exhibiting a resistivity of at least about $10^{15}$ ohm — cm.) wherein the polyester contains within the polymer chain at least about 30 mole percent of at least one divalent alkylene radical having no center of symmetry represented by the structural formula:

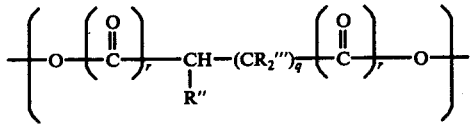

wherein R'' is an alkyl radical containing from 1 to about 4 carbon atoms, each R''' is independently hydrogen or R'', $q$ is a number from 1 to about 10 and each $r$ is independently a number from 0 to 1, the balance of the polyester being at least about 20 mole percent aromatic comonomer, and additional aromatic comonomer or aliphatic comonomer or both.

22. A finely divided particulate toner composition comprising a colorant and an amorphous, low-melting copolyester exhibiting a softening temperature of at least about 45° C, fusing at temperatures ranging from about 100° C to about 130° C and exhibiting a resistivity of at least about $10^{15}$ ohm—cm., wherein the copolyester contains within the polymer chain at least about 30 mole percent of at least one divalent radical selected from the group consisting of:

a. an arylene radical having no center of symmetry represented by the formula:

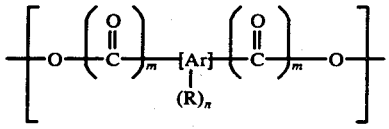

wherein [AR] is an arylene radical containing from 6 to about 18 carbon atoms, R is selected from the group of radicals consisting of hydrogen, alkyl containing from 1 to about 4 carbon atoms, halo, sulfo and alkali metal salts thereof, nitro, cyano lower alkoxy, amino, thio lower alkoxy and —N(R')p wherein each R' can be independently hydrogen or lower alkyl and *p* is an integer of 2 or 3, each *m* is independently a number from 0 to 1 and *n* is a number from 0 to 3, and b. an alkylene radical having no center of symmetry represented by the structural formula:

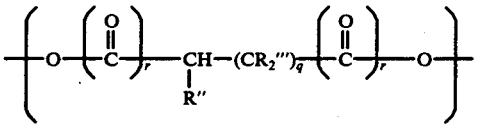

wherein R'' is an alkyl radical containing from 1 to about 4 carbon atoms, each R''' is independently hydrogen or R'', *q* is a number from 1 to about 10 and each *r* is independently a number from 0 to 1; and when the radical having no center of symmetry is at least about 30 mole percent of said arylene, the remaining comonomers of the copolyester consist essentially of at least two comonomers selected from the group consisting of aromatic, aliphatic and combinations thereof, and when the radical having no center of symmetry is at least about 30 mole percent of said alkylene, the remaining comonomers of the copolyester consist essentially of at least about 20 mole percent aromatic comonomer and at least one additional comonomer selected from the group consisting of aromatic, aliphatic and combinations thereof.

23. A finely divided particulate toner composition comprising a colorant and an amorphous, low-melting copolyester exhibiting a softening temperature of at least about 45° C, fusing at temperatures ranging from about 100° C to about 130° C and exhibiting a resistivity of at least about $10^{15}$ ohm — cm.), wherein the copolyester contains within the polymer chain at least one divalent radical selected from the group consisting of:

a. an arylene radical having no center of symmetry and selected from the group consisting of arylene dicarboxy radicals, arylene dioxy radicals and mixtures thereof, and b. an alkylene radical having no center of symmetry and selected from the group consisting of alkylene dioxy radicals, alkylene dicarboxy radicals and mixtures thereof;

at least two additional comonomers capable of reacting with the arylene radical of (*a*) or the alkylene radical of (*b*) to form the copolyester; and when the arylene radical is the divalent radical, the at least two additional comonomers are selected from the group consisting of aliphatic diols, aromatic diols, aliphatic diacids, aliphatic diesters, aromatic diacids, aromatic diesters, anhydrides of aromatic diacids, and mixtures thereof, and when the alkylene radical is the divalent radical, the copolyester comprises at least 20 mole percent of an aromatic comonomer selected from the group consisting of aromatic diacids, the anhydrides of the aromatic diacids, the acid chlorides of the aromatic diols and mixtures thereof and at least one additional comonomer selected from the group consisting of alkylene dioxy radicals, alkylene dicarboxy radicals, aromatic diacids, aromatic diesters, the anhydrides of the aromatic diacids, the acid chlorides of the aromatic diacids, aromatic diols, the salts of the aromatic diacids and mixtures thereof.

* * * * *